US009016517B2

(12) United States Patent
Craft

(10) Patent No.: US 9,016,517 B2
(45) Date of Patent: Apr. 28, 2015

(54) METHOD AND APPARATUS FOR BEVERAGE EXTRACTION NEEDLE FORCE INDICATION

(71) Applicant: Coravin, LLC, Burlington, MA (US)

(72) Inventor: Adam Brierley Craft, Mansfield, MA (US)

(73) Assignee: Coravin, Inc., Burlington, MA (US)

( * ) Notice: Subject to any disclaimer, the term of this patent is extended or adjusted under 35 U.S.C. 154(b) by 93 days.

(21) Appl. No.: 13/793,389

(22) Filed: Mar. 11, 2013

(65) Prior Publication Data

US 2014/0124530 A1 May 8, 2014

Related U.S. Application Data

(60) Provisional application No. 61/723,513, filed on Nov. 7, 2012.

(51) Int. Cl.
*B67D 1/04* (2006.01)

(52) U.S. Cl.
CPC ..... *B67D 1/0412* (2013.01); *B67D 1/0418* (2013.01)

(58) Field of Classification Search
CPC .. B67D 1/0418; B67D 1/0412; G01P 15/036; G01P 1/127
USPC ..... 222/83, 23, 465.1, 399
See application file for complete search history.

(56) References Cited

U.S. PATENT DOCUMENTS

| | | | | |
|---|---|---|---|---|
| 718,163 | A | | 1/1903 | Sherrard |
| 1,509,916 | A | | 9/1924 | Waite |
| 2,367,077 | A | | 1/1945 | Ward |
| 2,496,258 | A | | 2/1950 | Alexander |
| 2,705,578 | A | * | 4/1955 | Burns ..... 141/17 |
| 2,843,076 | A | * | 7/1958 | Cook et al. ..... 116/203 |
| 3,140,910 | A | * | 7/1964 | Duke et al. ..... 346/7 |
| 3,191,533 | A | | 6/1965 | Vandenberg |
| 3,200,094 | A | | 8/1965 | Levinson et al. |
| 3,203,592 | A | * | 8/1965 | Farandatos ..... 222/5 |
| 3,227,310 | A | * | 1/1966 | Farandatos ..... 222/5 |
| 3,272,404 | A | | 9/1966 | Graves et al. |
| 3,327,899 | A | | 6/1967 | Reynolds et al. |
| 3,883,043 | A | * | 5/1975 | Lane ..... 222/82 |
| 3,976,221 | A | | 8/1976 | Martin et al. |
| 4,011,971 | A | | 3/1977 | Haydon |
| 4,143,678 | A | | 3/1979 | Sugimura et al. |
| 4,473,174 | A | | 9/1984 | Heuser |
| 4,475,576 | A | | 10/1984 | Simon |
| 4,595,121 | A | | 6/1986 | Schultz |
| 4,674,662 | A | | 6/1987 | Bergstrom et al. |

(Continued)

FOREIGN PATENT DOCUMENTS

WO WO 2005058744 A2 6/2005

OTHER PUBLICATIONS

International Search Report dated Feb. 4, 2014 from corresponding PCT Application No. PCT/US2013/066265.

*Primary Examiner* — Donnell Long
(74) *Attorney, Agent, or Firm* — Wolf, Greenfield & Sacks, P.C.

(57) ABSTRACT

Devices and methods for guiding a needle in movement through a bottle closure, such as a cork, to extracting fluids from the bottle without removal of the cork. A force indicator may indicate when a force exceeding a threshold value is applied to the needle during insertion and/or withdrawal of the needle from a cork.

22 Claims, 7 Drawing Sheets

(56) References Cited

U.S. PATENT DOCUMENTS

| | | | | |
|---|---|---|---|---|
| 4,691,482 | A | | 9/1987 | Heinemann et al. |
| 4,694,850 | A | | 9/1987 | Fumino |
| 4,706,847 | A | | 11/1987 | Sankey et al. |
| 4,856,680 | A | | 8/1989 | Sitton |
| 4,867,209 | A | | 9/1989 | Santoiemmo |
| 4,932,561 | A | | 6/1990 | Boxall |
| 4,976,984 | A | | 12/1990 | Yasukawa et al. |
| 4,982,879 | A | | 1/1991 | Corrando et al. |
| 4,984,711 | A | * | 1/1991 | Ellis ..... 222/82 |
| 5,014,798 | A | * | 5/1991 | Glynn ..... 177/25.19 |
| 5,020,395 | A | | 6/1991 | Mackey |
| 5,031,799 | A | | 7/1991 | Owen |
| 5,139,179 | A | | 8/1992 | Cecil |
| 5,163,909 | A | | 11/1992 | Stewart |
| 5,180,081 | A | | 1/1993 | McCann |
| 5,395,012 | A | | 3/1995 | Grill et al. |
| 5,407,096 | A | | 4/1995 | Smith |
| 5,413,230 | A | | 5/1995 | Folter et al. |
| 5,413,247 | A | | 5/1995 | Glasa |
| 5,590,696 | A | | 1/1997 | Phillips et al. |
| 5,947,172 | A | | 9/1999 | Glotin |
| 6,371,173 | B1 | | 4/2002 | Liebmann, Jr. |
| 6,477,920 | B1 | * | 11/2002 | Yang ..... 81/3.2 |
| 6,607,100 | B2 | | 8/2003 | Phelps et al. |
| 6,789,698 | B2 | | 9/2004 | Gloor et al. |
| 6,843,388 | B1 | | 1/2005 | Hollars |
| 7,056,179 | B2 | | 6/2006 | Courtney |
| 7,712,637 | B2 | * | 5/2010 | Lambrecht ..... 222/400.7 |
| 7,815,865 | B2 | * | 10/2010 | Hoffman et al. ..... 422/400 |
| 8,033,431 | B2 | | 10/2011 | Sommerfield et al. |
| 8,225,959 | B2 | | 7/2012 | Lambrecht |
| 2002/0134794 | A1 | * | 9/2002 | McManus et al. ..... 222/55 |
| 2007/0034592 | A1 | * | 2/2007 | Pavlovic et al. ..... 215/253 |
| 2009/0068066 | A1 | * | 3/2009 | Hoffman et al. ..... 422/100 |
| 2010/0006603 | A1 | | 1/2010 | Weinberg |
| 2011/0016692 | A1 | | 1/2011 | Hollars |

* cited by examiner

METHOD AND APPARATUS FOR BEVERAGE EXTRACTION NEEDLE FORCE INDICATION

RELATED APPLICATIONS

This application claims the benefit under 35 U.S.C. §119 (e) of U.S. provisional application No. 61/723,513, filed Nov. 7, 2012, which is incorporated by reference herein in its entirety.

BACKGROUND OF INVENTION

This invention relates generally to the dispensing or other extraction of fluids from within a container, e.g., in the dispensing of wine from a wine bottle.

SUMMARY OF INVENTION

One or more embodiments in accordance with aspects of the invention allow a user to withdraw or otherwise extract a beverage, such as wine, from within a container that is sealed by a cork, plug, elastomeric septum or other closure without removing the closure. In some cases, removal of liquid from such a container may be performed one or more times, yet the closure may remain in place during and after each beverage extraction to maintain a seal for the container. Thus, the beverage may be dispensed from the bottle multiple times and stored for extended periods between each extraction with little or no effect on beverage quality. In some embodiments, little or no gas, such as air, which is reactive with the beverage may be introduced into the container either during or after extraction of beverage from within the container. Thus, in some embodiments, a user may withdraw wine from a wine bottle without removal of, or damage to, the cork, and without allowing air or other potentially damaging gasses or liquids entry into the bottle.

In one aspect of the invention, a beverage extraction device includes a base for supporting components of the beverage extraction device, and a needle movably mounted to the base and arranged to be inserted through a closure at an opening of a beverage container. The needle may extend from a proximal end to a distal end and have at least one lumen that is arranged for introducing gas into a container or allowing beverage to flow from the container. The device may include a force indicator that provides an indication when a force applied to the needle to insert the needle into or withdraw the needle from a closure exceeds a threshold valve. For example, if the needle is worn, the closure is too resistant to penetration by the needle, or other conditions exist that might require an unacceptably high force to be applied to the needle, an indicator may alert a user to the condition. In response, the user may stop insertion/withdrawal of the needle, may complete insertion/withdrawal but later replace the needle, or take other action.

The needle may be arranged to be used with closures that include a material capable of resealing upon withdrawal of the needle from the closure. For example, typical wine bottle corks may allow a needle to be passed through the cork to extract wine from the bottle, and then reseal upon removal of the needle such that gas and/or liquid are prevented from passing through the cork after needle removal.

Various exemplary embodiments of the device are further depicted and described below.

BRIEF DESCRIPTION OF THE DRAWINGS

Aspects of the invention are described with reference to various embodiments, and to the figures, which include.

DETAILED DESCRIPTION

Aspects of the invention are described below with reference to illustrative embodiments, but it should be understood that aspects of the invention are not to be construed narrowly in view of the specific embodiments described. Thus, aspects of the invention are not limited to the embodiments described herein. It should also be understood that various aspects of the invention may be used alone and/or in any suitable combination with each other, and thus various embodiments should not be interpreted as requiring any particular combination or combinations of features. Instead, one or more features of the embodiments described may be combined with any other suitable features of other embodiments.

Figure 1:
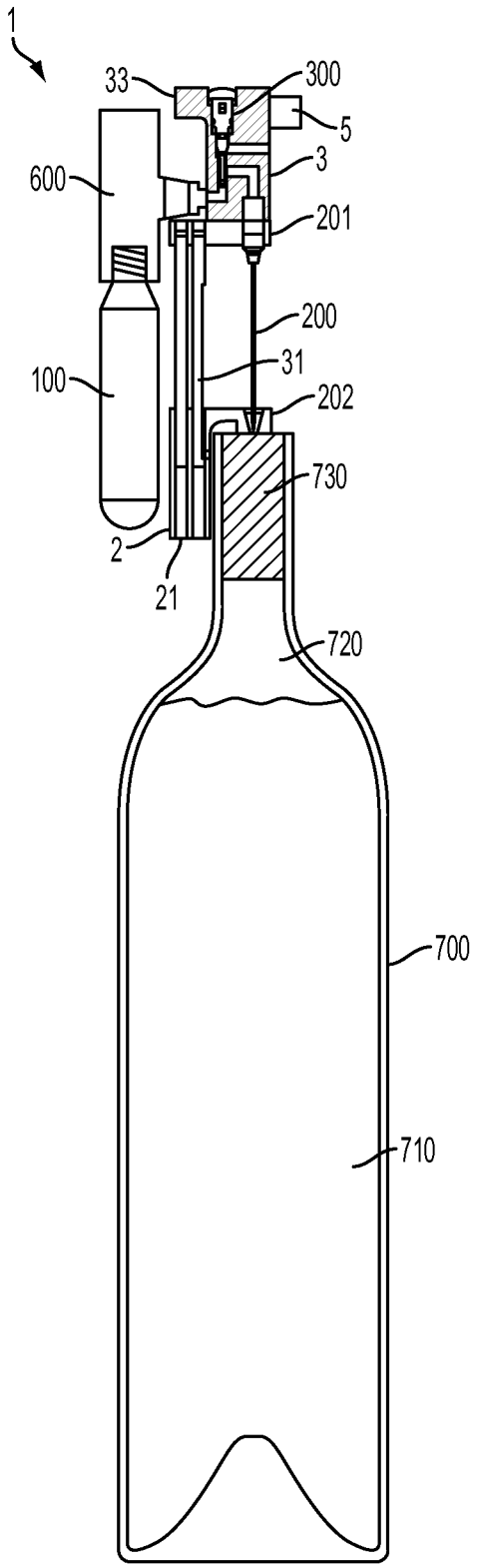
FIG. 1 shows a sectional side view of a beverage extraction device in preparation for introducing a needle through a closure of a beverage container.

FIG. 1 shows one embodiment of a beverage extraction system 1 that incorporates one or more aspects of the invention. This illustrative system 1 includes a body 3 with an attached pressurized source of gas 100 (such as a compressed gas cylinder) that provides gas under pressure (e.g., 2600 psi or less as dispensed from the cylinder) to a regulator 600. In this arrangement, the cylinder 100 is secured to the body 3 and regulator 600 by a threaded connection, although other configurations are possible, such as those described in U.S. Pat. No. 4,867,209; U.S. Pat. No. 5,020,395; and U.S. Pat. No. 5,163,909 which are hereby incorporated by reference with respect to their teachings regarding mechanisms for engaging a gas cylinder with a cylinder receiver. The regulator 600 is shown schematically and without detail, but can be any of a variety of commercially available or other single or two-stage pressure regulators capable of regulating gas pressures to a pre-set or variable outlet pressure. The main function of the regulator 600 is to provide gas at a pressure and flow rate suitable for delivery to the container 700, e.g., so that a pressure established inside the container 700 does not exceed a desired level.

In this embodiment, the body 3 also includes a valve 300 operable to control the flow of gas from the regulator 600. The valve 300 may be a 3-way toggle valve that includes a single operation button and functions to selectively introduce pressurized gas into the container 700 and extract beverage 710 (such as wine) from the container 700 via a needle 200. Details regarding the operation of such a valve 300 are provided in U.S. Pat. No. 8,225,959, which is incorporated by reference in its entirety. Of course, other valve arrangements for controlling pressurized gas and beverage flow are possible. For example, the 3-way valve 300 could be replaced with a pair of on/off valves, one for controlling gas introduction to the container 700, and another for controlling flow of beverage from the container 700. Each valve could have its own actuator, allowing a user to selectively open and close the valves, whether individually or simultaneously. In short, details regarding the operation of the regulator 600 and valve 300 or other mechanisms for introducing gas into a container, and removing beverage from the container 700 are not necessarily limitations on aspects of the invention and may be modified as suitable.

To introduce gas into the container 700 and extract beverage, a needle 200 attached to the body 3 is inserted through a cork or other closure 730 that seals an opening of the container 700. This illustrative system 1 uses a pencil-tip non-coring needle 200 with a needle opening 220 along a sidewall of the needle near the needle tip. While the needle 200 may be inserted into the cork or other closure 730 in different ways, in this embodiment, the system 1 includes a base 2 with a pair of channels 21 that receive and guide movement of respective rails 31 of the body 3. Thus, movement of the body 3 and attached needle 200 relative to the container closure 730 may be guided by the base 2. Other arrangements for guiding movement of the body 3 relative to the base 2 are possible, such as providing one or more rails on the base 2 which engage with the body 3, providing an elongated slot, channel or groove on the body or base which engages with a corresponding feature (e.g., a tab) on the other of the body or base and allows for sliding movement, a linkage that connects the body and base together and allows for movement of the body to insert the needle into the closure, and others. In yet other embodiments, the base 2 need not be provided, and instead the needle 200 and body 3 may be manipulated to insert/withdraw the needle 200 without use of a base 2.

In some embodiments, the base 2 may be fixed or otherwise held in place relative to the container 700, e.g., by a clamp, sleeve, strap or other device that engages with the container 700. By fixing the base 2 relative to the container 700, such an arrangement may help guide motion of a needle 200 relative to the container 700 when penetrating a closure 730, or when being withdrawn from the closure 730. In another embodiment, the base 2 may include a component that receives a larger part of the container 700, such as a stand that supports a bottom of the container 700 so that the container is effectively held in place relative to the base 2. Alternately, a user may simply hold the base 2 in place relative to the container 700, e.g., by simultaneously gripping a part of the base 2 and a neck of the container 700.

Figure 2:
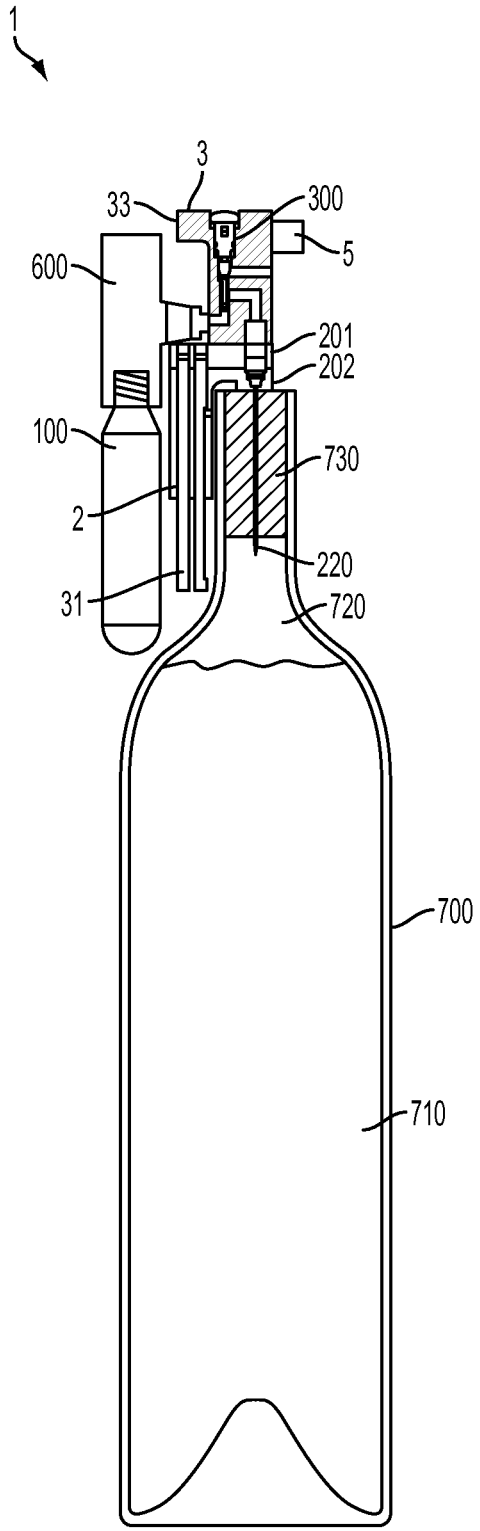
FIG. 2 shows the FIG. 1 embodiment with the needle passed through the closure.
Figure 3:
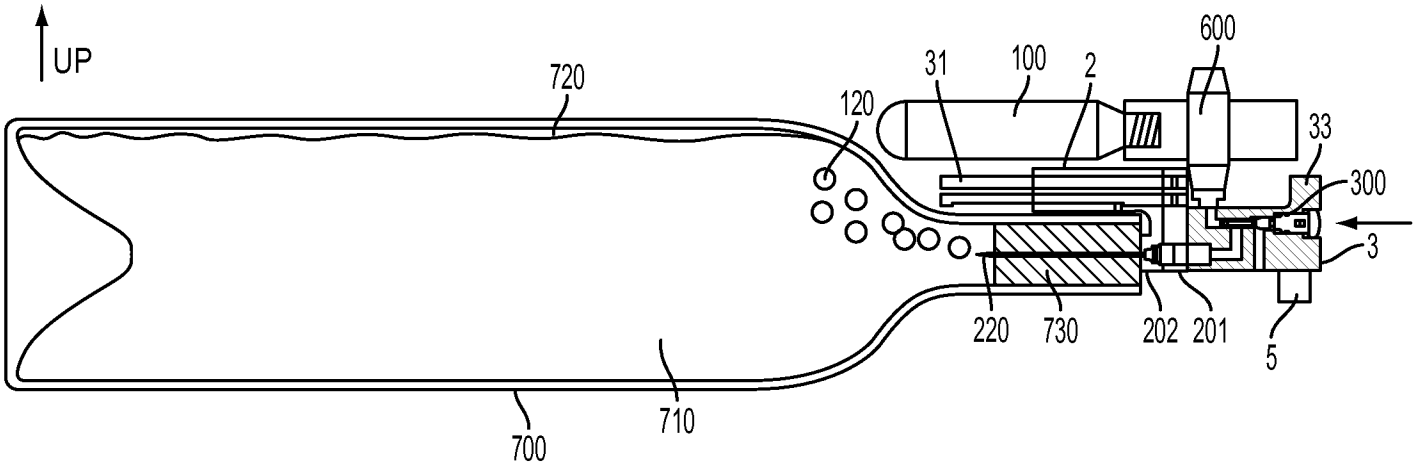
FIG. 3 shows the FIG. 1 embodiment while introducing gas into the container.
Figure 4:
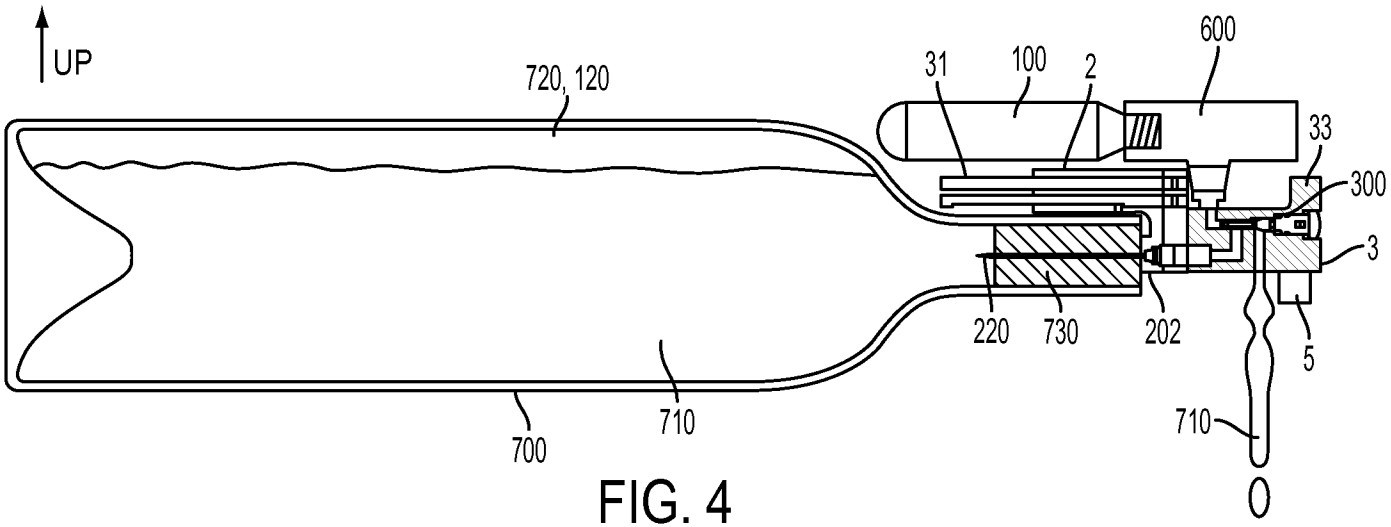
FIG. 4 shows the FIG. 1 embodiment while dispensing beverage from the container.

To insert the needle 200 through the closure 730, a user may push downwardly on the body 3 while maintaining the base 2 and the container 700 stationary relative to each other. The needle 200 will pass through the closure 730, guided in its motion, at least in part, by the guided motion of the body 3 relative to the base 2 (e.g., by the rails 31 and channels 21). With the needle 200 suitably inserted as shown in FIG. 2, a needle opening 220 at the needle tip may be positioned below the closure 730 and within the enclosed space of the container 700. The container 700 may then be tilted, e.g., so that the beverage 710 flows to near the closure 730 and any air or other gas 720 in the container 700 flows away from the closure. Pressurized gas 120 may then be introduced into the container 700 by actuating the valve 300 and causing gas from the cylinder 100 to flow through the valve 300 and needle 200 to exit at the needle opening 220, as shown in FIG. 3. Thereafter, the valve 300 may be operated to stop the flow of pressurized gas and allow beverage 710 to flow into the needle opening 220 and through the needle 200 to be dispensed from the valve 300, as shown in FIG. 4.

In accordance with an aspect of the invention, the beverage extraction system 1 includes a force indicator 5 that provides an indication when a force exerted on the needle to insert and/or withdraw the needle with respect to a closure 730 exceeds a threshold value. For example, if the needle is worn, e.g., the needle outer surface is roughened and/or a PTFE coating or other material on the needle that helps ease movement of the needle through the closure 730 is removed or damaged, a force needed to move the needle through the closure 730 may be higher than desired. Such high forces may risk damaging the needle, e.g., by bending or breaking the needle, or other components of the device 1. In such a circumstance, the force indicator 5 may provide an indication, e.g., an audible, tactile and/or visual indication, that a force applied to the needle 200 is greater than a threshold. Depending on how the force indicator 5 is arranged to operate, the force indicator 5 may include a variety of different components. For example, the force indicator 5 could include a strain gage that senses when a portion of the body 3 and/or the needle 200 experiences a strain that exceeds a threshold value, and thus indicates that a force exceeding a threshold value is being exerted on the needle 200. In this example, the force indicator 5 could include a suitable electronic circuit to sense the signal provided by the strain gage, compare the strain indication signal from the strain gage to a defined value, and if the strain signal exceeds the defined value, provide a visual (e.g., illuminate a red lamp), tactile (e.g., release a button or other portion of the body 3 at or adjacent a handle 33 that can be felt by a user), and/or an audible (e.g., an alarm, clicking sound, or other sound) indication to the user. While in this embodiment, a handle 33 is simply any part of the body 3 that can be gripped by a user to move the body 3 and needle 200, the body 3 could include a defined handle 33, such as a ring or loop that can be grasped by one or more fingers.

Figure 5:
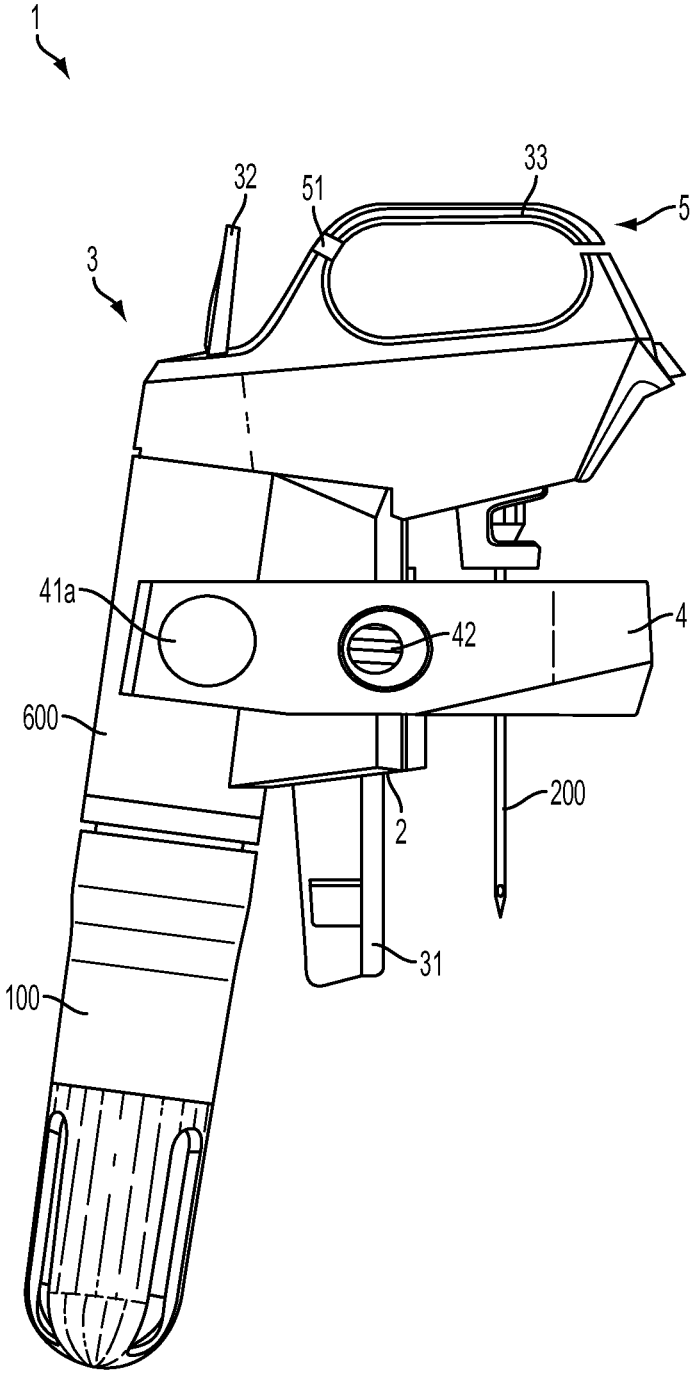
FIG. 5 shows a side view of an illustrative embodiment of a beverage extraction system including a container clamp and a force indicator associated with a handle.
Figure 6:
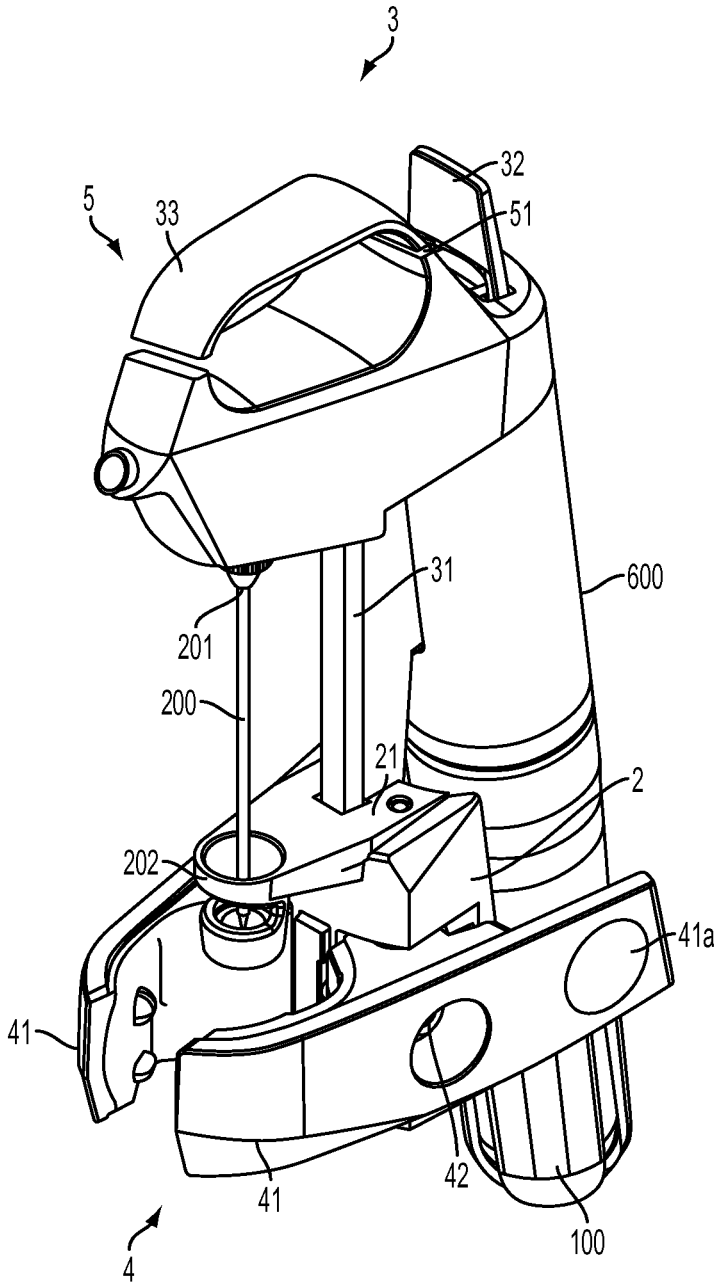
FIG. 6 shows a perspective view of the FIG. 5 embodiment.

FIGS. 5 and 6 show another illustrative embodiment of a beverage extraction system 1 that incorporates aspects of the invention. In this embodiment, the body 3 includes a handle 33, that may be gripped by a user for moving the body 3 relative to the base 2 in upward and downward motions to insert a needle 200 through a cork or other closure of a container 700. The body 3 includes a rail 31 that has T-shaped cross section, and is arranged to move within a T-shaped receiving slot 21 of the base 2. As discussed above, other arrangements are possible for engaging the body 3 and base 2 while allowing for movement of the needle 200. In addition, the base 2 need not be included.

In accordance with an aspect of the invention, a force indicator 5 is associated with the handle 33 and is arranged to provide an indication if a force applied to the needle exceeds a threshold value, whether during needle insertion and/or withdrawal. In this illustrative embodiment, the force indicator 5 includes a hinge or detent 51 that connects a part of the handle 33 to the body 3. The hinge or detent 51 is arranged so that if a force exceeding a threshold value is applied to the handle 33, the handle 33 may move relative to the body 3 to indicate the excessive force condition. Note that the force applied to the handle 33 need not necessarily correspond exactly to a force applied to the needle 200, but may be used to indicate a force applied to the needle. Thus, in conditions where the force applied to the handle 33 is below a threshold, the handle 33 may remain stationary relative to the body 3. However, if the force applied to the handle exceeds the threshold, the handle 33 may move toward or away from the body 3 (depending on whether the needle is being inserted or withdrawn), providing a force indication to the user. As will be understood, the hinge or detent 51 may include a spring or other resilient element that helps to hold the handle 33 in place relative to the body 3, but will allow for movement of the handle 33 in excessive force conditions.

In addition, or alternately, the force indicator 5 may include an element that provides an audible click or other sound when excessive force is applied to the handle. For example, the hinge or detent 51 may allow the handle 33 to move only a very small amount relative to the body 3, but even such small movement may cause the audible indication to issue.

The force indicator 5 may also, or alternately, include a visible element that provides a force indication. For example, in this embodiment, a red or other colored flag may be attached to the handle 33 at an end of the handle 33 opposite the hinge/detent 51 (e.g., near the gap between the handle 33 and body 3 in this embodiment). With the handle 33 in the normal position shown in FIGS. 5 and 6, the flag may not be visible. However, if the handle 33 is move away from the body 3 about the hinge/detent 51, the flag may be withdrawn from a receiving slot in the body 3 and be made visible to the user. The flag may also function as a stop to further movement of the handle 33, e.g., prevent the handle 33 from being moved back toward the body 3 without a user clearing the flag (e.g., by aligning the flag with the receiving slot of the body 3 to allow the flag to be again inserted into the slot). In this way, the user may be further reminded of the excessive force condition.

Of course, other arrangement for the force indicator 5 are possible. For example, a strain gage (described above) may be positioned at the hinge/detent 51 location (or elsewhere) to detect a force exerted on the handle 33, and thus indicative of a force on the needle. In another arrangement, movement of the handle 33 (or a portion of it) may release a spring loaded button or other indicator that extends from the body 3 or handle 33 in an excessive force condition. In another embodiment, electronic circuitry may issue a visual display (e.g., an illuminated lamp or display on a display screen) or audible alarm in an excessive force condition. The circuitry may detect the force condition using a strain gage, micro switch, or other physical characteristic of the handle 33, body 3, and/or needle 200.

Figure 7:
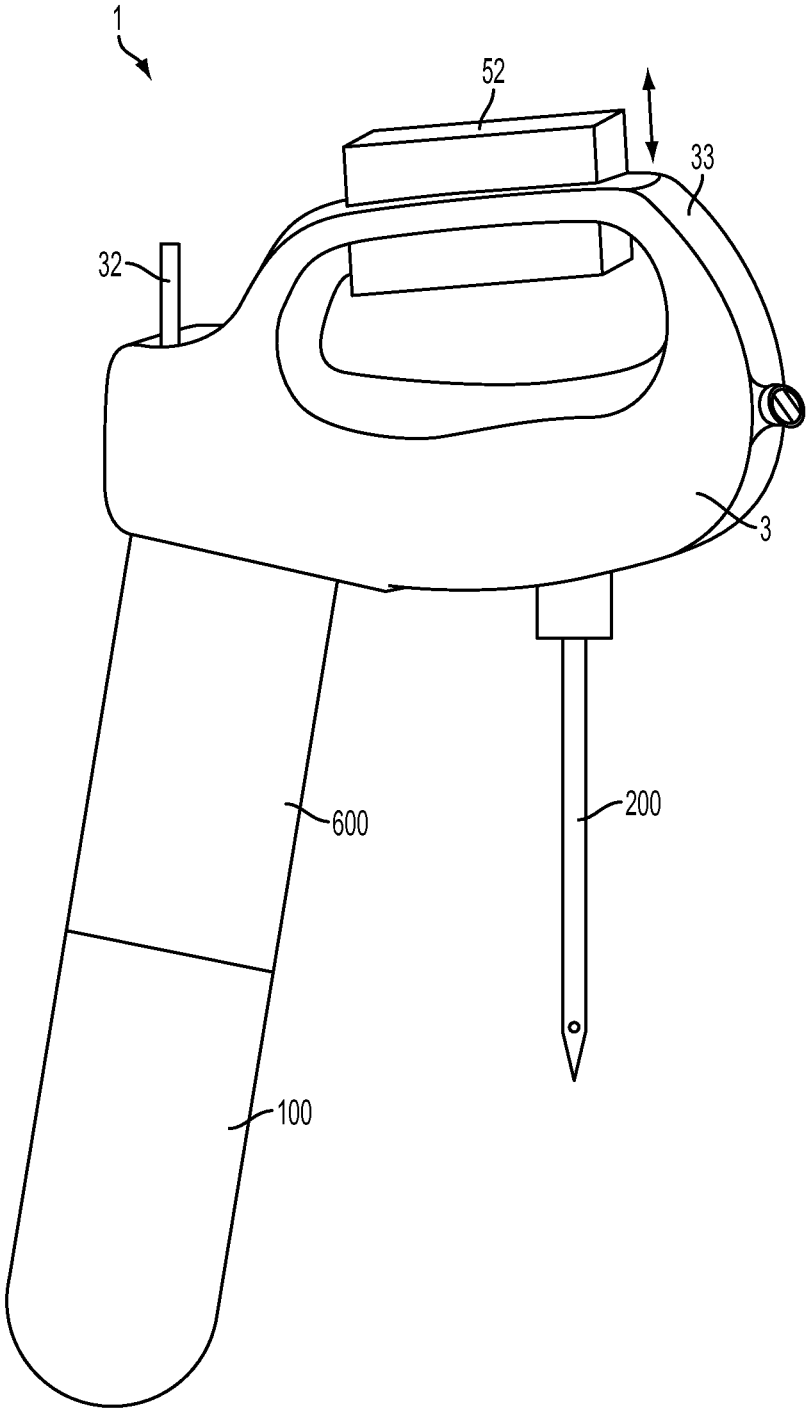
FIG. 7 shows another illustrative embodiment of a force indicator arrangement.

FIG. 7 shows another illustrative embodiment in which the force indicator 5 includes a movable element 52 (which is part of the handle 33) mounted for up and down movement relative to a stationary part of the handle 33. The movable element 52 may be mounted to the stationary part of the handle 33 with a spring bias such that the movable element 52 resists movement relative to the handle 33, and will only move to provide a force indication when a force exceeding a threshold value is applied to the movable element 52. For example, sufficient movement of the element 52 relative to the handle 33 may provide an audible click, may cause release of a spring loaded button or flag, may close/open a switch which is detected by circuitry that in response provides the force indication (lamp illumination, display, flag release, etc.), and so on.

While in the illustrated embodiments, the force indicator is located on or near the handle 33, other locations are possible, as are multiple locations. For example, the indicator 5 could be located near or at the needle 200. In fact, the indicator 5 could be arranged to directly detect a force applied to the needle, rather than a force that is remote from the needle. For example, the indicator 5 could include a frangible element at the connection point of the needle 200 to the body 3 that breaks when an excessive force is applied to the needle, but does not result in the needle 200 being disconnected from the body 3. Breaking of the frangible element may reveal a red or other colored portion to provide a visual indication, in addition to the audible crack that might be emitted by the frangible element. In one embodiment, the frangible element may be a sleeve that connects two portions of the needle together, but breaks when an excessive force is transmitted through the element. Other arrangements are possible.

The embodiment FIGS. 5 and 6 includes a clamp 4 to engage the base 2 with a container 700, e.g., by clamping to the neck of a bottle. The clamp 4 includes two arms 41 and a locking mechanism that includes a pair of torsion springs 42 to secure the arms 41 to a container. That is, each arm 41 is pivotally mounted to the base 2 at respective a pivot axis so that distal ends of the arms 41 (i.e., portions near the needle guide 202) may be moved toward and away from each other by moving finger pad portions 41*a* of the arms 41 toward and away from each other. With the needle guide 202 positioned over the closure 730, the arms 41 may be moved to position the neck of a container between the distal ends of the arms. The arms 41 may then be moved to clamp the neck, e.g., by releasing the finger pad portions 41*a* and allowing the torsion springs 42 to urge the distal ends of the arms together around the neck. Alternately, the arms 41 may be secured together in other ways, such as by a ratchet and pawl mechanism, a detent, a buckle and strap, a screw and nut (in which the screw engages one arm 41, the nut engages the other arm 41, and the screw and nut threadedly engage each other to secure the arms 41 together) or other arrangement suited to engage the arms 41 with the container 700.

The clamp 4 may also operate to ensure that the cork is centered beneath the needle 200 and that the needle guide 202 rests atop the cork or other closure. Of course, the clamp 4 could be arranged in other ways, e.g., replaced by a cylinder that fits over a bottle neck and has a split wall with a conically tapered outer surface. An outer ring could be slid along the conical surface of the cylinder to cause the inner diameter of the cylinder to decrease, clamping the cylinder about the bottle neck. Other arrangements are possible. Also, the needle guide 202 may function to help retain a closure 730 in the container opening by maintaining the closure in position relative to the container 700, whether during use of the system 1 (e.g., introduction of pressurized gas into the container 700) or during withdrawal of the needle 200 from the closure. That is, the needle guide 202 may contact the top of the closure 730 and resist upward movement of the closure 730 relative to the container opening.

It has been found that needles having a smooth walled exterior, pencil point or Huber point needle of 16 gauge or higher are effective to penetrate through a wine bottle cork or other closure, while sealing effectively with the cork to prevent the ingress or egress of gases or fluids during beverage extraction. Moreover, such needles allow the cork to reseal after withdrawal of the needle, allowing the container and any remaining beverage to be stored for months or years without abnormal alteration of the beverage flavor. Further, such needles may be used to penetrate a foil cover or other wrapping commonly found on wine bottles and other containers. Thus, the needle may penetrate the foil cover or other element as well as the closure, eliminating any need to remove the foil or other wrapping prior to beverage extraction. Other needle profiles and gauges are also usable with the system.

While in the above embodiments, a user moves the body 3 in a linear fashion relative to the base 2 to insert/remove a needle with respect to a container closure, a manual or powered drive mechanism may be used to move a needle relative to a closure. For example, a rail 31 may include a toothed rack, while the base 2 may include a powered pinion gear that engages the rack and serves to move the body 3 relative to the base 2. The pinion may be powered by a user-operated handle, a motor, or other suitable arrangement. In another embodiment, the needle may be moved by a pneumatic or hydraulic piston/cylinder, e.g., which is powered by pressure from the gas cylinder 100 or other source.

A needle used in a beverage extraction system may be a smooth exterior walled, cylindrical needle with a non-coring tip that can be passed through a cork without removing material from the cork. One non-coring tip is a pencil-tip that dilates a passageway through the cork, although deflected-tip and stylet needles have also been found to work properly and could be used in alternative embodiments. The pencil-tip needle preferably has at least one lumen extending along its length from at least one inlet on the end opposite the pencil-tip and at least one outlet proximal to the pencil-tip. As shown above, a needle outlet may be positioned in the side-wall of the needle at the distal end of the needle, although proximal of the extreme needle tip.

With the correct needle gauge, it has been found that a passageway (if any) that remains following removal of the needle from a cork self-seals against egress or ingress of fluids and/or gasses under normal storage conditions. Thus, a needle may be inserted through a closure to extract beverage, and then be removed, allowing the closure to reseal such that beverage and gas passage through the closure is prevented. While multiple needle gauges can work, preferred needle gauges range from 16 to 22 gauge, with an optimal needle gauge in some embodiments being between 17 and 20 gauge. These needles gauges may offer optimal fluid flow with minimal pressures inside the container while doing an acceptably low level of damage to the cork even after repeated insertions and extractions.

Multiple needle lengths can be adapted to work properly in various embodiments, but it has been found that a minimum needle length of about 1.5 inches is generally required to pass through standard wine bottle corks. Needles as long as 9 inches could be employed, but the optimal range of length for some embodiments has been found to be between 2 and 2.6 inches. The needle may be fluidly connected to the valve directly through any standard fitting (e.g. NPT, RPT, Leur, quick-connect or standard thread) or alternatively may be connected to the valve through an intervening element such as a flexible or rigid tube. When two or more needles are used, the needle lengths may be the same or different and vary from 0.25 inches to 10 inches. Creating distance between the inlet/outlets of the needles can prevent the formation of bubbles.

In some embodiments, a suitable gas pressure is introduced into a container to extract beverage from the container. For example, with some wine bottles, it has been found that a maximum pressure of between around 40 and 50 psi may be introduced into the bottle without risking leakage at, or ejection of, the cork, although pressures of between around 15 and 30 psi have been found to work well. These pressures are well tolerated by even the weakest of cork-to-bottle seals at the bottle opening without causing cork dislodging or passage of liquid or gas by the cork, and provide for relatively fast beverage extraction. The lower pressure limit in the container during wine extraction for some embodiments has been found to be between about 0 and 20 psi. That is, a pressure between about 0 and 20 psi has been found needed in a bottle to provide a suitably fast extraction of beverage from the bottle. In one example using a single 17 to 20 gauge needle, a pressure of 30 psi was used to establish an initial pressure in a wine bottle, and rapid wine extraction was experienced even as the internal pressure dropped to about 15-20 psi.

The source of pressurized gas can be any of a variety of regulated or unregulated pressurized gas containers filled with any of a variety of non-reactive gasses. In a preferred embodiment, the gas cylinder contains gas at an initial pressure of about 2000-3000 psi. This pressure has been found to allow the use of a single relatively small compressed gas cylinder (e.g., about 3 inches in length and 0.75 inches in diameter) for the complete extraction of the contents of several bottles of wine. Multiple gasses have been tested successfully over extended storage periods, and preferably the gas used is non-reactive with the beverage within the container, such as wine, and can serve to protect the beverage oxidation or other damage. Suitable gases include nitrogen, carbon dioxide, argon, helium, neon and others. Mixtures of gas are also possible. For example, a mixture of argon and another lighter gas could blanket wine or other beverage in argon while the lighter gas could occupy volume within the bottle and perhaps reduce the overall cost of the gas.

The embodiment above, a single needle with a single lumen is used to introduce gas into the container and extract beverage from the container. However, in other embodiments two or more needles may be used, e.g., one needle for gas delivery and one needle for beverage extraction. In such an embodiment, the valve 300 may operate to simultaneously open a flow of gas to the container and open a flow of beverage from the container. The needles may have the same or different diameters or the same or different length varying from 0.25 to 10 inches. For example, one needle delivering gas could be longer than another that extracts wine from the bottle. Alternately, a two lumen needle may be employed where gas travels in one lumen and beverage travels in the other. Each lumen could have a separate entrance and exit, and the exits could be spaced from each other within the bottle to prevent circulation of gas.

Multiples of these components could be combined into single parts or components serving multiple functions. For example, the needle guide may be made part of a container clamp.

While aspects of the invention have been shown and described with reference to illustrative embodiments, it will be understood by those skilled in the art that various changes in form and details may be made therein without departing from the scope of the invention encompassed by the appended claims.

The invention claimed is:

1. A beverage extraction device, comprising:

a body having a handle for gripping by a user to move the body;

a needle having at least one lumen extending from a proximal end to a distal end, the needle being attached to the body and arranged to be inserted through a closure at an opening of a beverage container to introduce gas through the needle into the beverage container or allow beverage to flow through the needle from the beverage container; and a needle force indicator that provides an indication when a force applied by a user to the handle to insert the needle through a closure of a beverage container or to withdraw the needle from a closure of a beverage container exceeds a threshold value.

2. The device of claim 1, wherein the needle force indicator provides an audible, tactile or visual indication when the force exceeds the threshold value.

3. The device of claim 1, wherein the needle force indicator includes a movable portion of the handle.

4. The device of claim 3, wherein the needle force indicator includes a detent that releases the movable portion of the handle in response to a force exerted on the movable portion that exceeds the threshold value.

5. The device of claim 1, wherein the needle force indicator includes a button that changes position relative to the body in response to a force exerted on the movable portion that exceeds the threshold value.

6. The device of claim 1, wherein the needle force indicator includes a strain gage that outputs a signal indicative of a force exerted on the handle.

7. The device of claim 1, wherein the handle includes a hinge, and a portion of the handle moves about the hinge when a force applied by a user to the handle to insert the needle through a closure or to withdraw the needle from a closure exceeds a threshold value.

8. The device of claim 1, wherein the handle includes a movable portion that slides relative to the body when a force applied by a user to the handle to insert the needle through a closure or to withdraw the needle from a closure exceeds a threshold value.

9. The device of claim 1, further comprising a gas source fluidly coupled to the needle and arranged to deliver pressurized gas to the at least one lumen at the proximal end of the needle.

10. The device of claim 9, wherein the gas source includes a compressed gas cylinder.

11. The device of claim 1, further comprising a base that engages the body to allow movement of the body relative to the base, wherein the body includes rail, and the base includes a channel arranged to receive and guide movement of the rail relative to the base.

12. The device of claim 1, wherein the needle is threadedly engaged with the body such that the needle is removable from the body.

13. The device of claim 1, wherein the needle is arranged for insertion through a cork of a wine bottle and for delivery of a gas into the wine bottle.

14. The device of claim 1, wherein the needle is arranged for insertion through a cork of a wine bottle and for delivery of wine from the bottle.

15. The device of claim 1, wherein the needle has an opening near the distal end of the needle.

16. A method for extracting a beverage from a container, comprising:

inserting a needle through a closure of a container by exerting a force to a body to which the needle is attached, the closure sealing an opening of the container closed prior to needle insertion such that a beverage in the container is prevented from passing through the opening;

extracting a beverage from the container via the needle while the needle is inserted through the closure; and indicating via an indicator on the body when a force applied to the body to insert the needle through the closure or to withdraw the needle from a closure exceeds a threshold value.

17. The method of claim 16, wherein the closure includes a material capable of resealing upon withdrawal of the needle from the closure.

18. The method of claim 16, wherein the step of extracting includes introducing gas into the container through the closure via the needle.

19. The method of claim 16, wherein the indicating step includes providing an audible, tactile or visual indication when the force exceeds the threshold value.

20. A beverage extraction device, comprising:

a body having a handle for gripping by a user to move the body;

a needle having at least one lumen extending from a proximal end to a distal end, the needle being attached to the body and arranged to be inserted through a closure at an opening of a beverage container; and a needle force indicator that provides an indication when a force applied by a user to the handle to insert the needle through a closure or to withdraw the needle from a closure exceeds a threshold value, wherein the needle force indicator includes a button that changes position relative to the body in response to a force exerted on the movable portion that exceeds the threshold value.

21. A beverage extraction device, comprising:

a body having a handle for gripping by a user to move the body;

a needle having at least one lumen extending from a proximal end to a distal end, the needle being attached to the body and arranged to be inserted through a closure at an opening of a beverage container; and a needle force indicator that provides an indication when a force applied by a user to the handle to insert the needle through a closure or to withdraw the needle from a closure exceeds a threshold value, wherein the handle includes a hinge, and a portion of the handle moves about the hinge when a force applied by a user to the handle to insert the needle through a closure or to withdraw the needle from a closure exceeds a threshold value.

22. A beverage extraction device, comprising:

a body having a handle for gripping by a user to move the body;

a needle having at least one lumen extending from a proximal end to a distal end, the needle being attached to the body and arranged to be inserted through a closure at an opening of a beverage container; and a needle force indicator that provides an indication when a force applied by a user to the handle to insert the needle through a closure or to withdraw the needle from a closure exceeds a threshold value, wherein the handle includes a movable portion that slides relative to the body when a force applied by a user to the handle to insert the needle through a closure or to withdraw the needle from a closure exceeds a threshold value.

* * * * *